US005927216A

United States Patent [19]

Ōga

[11] Patent Number: 5,927,216

[45] Date of Patent: Jul. 27, 1999

[54] BURNER APPARATUS

[75] Inventor: Shigeru Ōga, Susono, Japan

[73] Assignee: Yamaichi Metal Co., Ltd., Nagaizumi-cho, Japan

[21] Appl. No.: 08/900,775

[22] Filed: Jul. 25, 1997

[30] Foreign Application Priority Data

Aug. 2, 1996 [JP] Japan ..... 8-220384
Jul. 24, 1997 [JP] Japan ..... 9-213982

[51] Int. Cl.[6] ..... F23B 7/00; F23G 5/20; F27B 7/14; F27B 7/32

[52] U.S. Cl. ..... 110/258; 110/229; 110/255; 110/246; 110/258; 110/260; 432/105; 432/117; 432/118; 48/189.5

[58] Field of Search ..... 110/218, 219, 110/222, 229, 232, 233, 235, 242, 246, 255, 258, 262, 260, 263; 48/66, 85, 85.2, 111, 189.5, 209; 432/103, 105, 108, 109, 113, 117, 118

[56] References Cited

U.S. PATENT DOCUMENTS

| | | | |
|---|---|---|---|
| 2,175,301 | 10/1939 | Moreton | 110/246 |
| 3,381,637 | 5/1968 | Farrell, Jr. et al. . | |
| 3,412,697 | 11/1968 | Matteini | 110/246 |
| 3,749,033 | 7/1973 | Sugano et al. . | |
| 3,771,263 | 11/1973 | Borggreen et al. . | |
| 3,787,038 | 1/1974 | Tesner et al. . | |
| 3,807,324 | 4/1974 | Williamitis . | |
| 4,137,029 | 1/1979 | Brooks . | |
| 4,205,613 | 6/1980 | Fio Rito et al. | 110/246 |
| 4,399,756 | 8/1983 | Lientz | 110/346 |
| 4,439,209 | 3/1984 | Wilwerding et al. . | |
| 4,459,921 | 7/1984 | Unger | 110/226 |
| 4,872,954 | 10/1989 | Hogan . | |
| 5,217,578 | 6/1993 | Taciuk et al. . | |
| 5,551,358 | 9/1996 | Burkhard et al. | 110/346 |
| 5,553,554 | 9/1996 | Urich, Jr. | 110/211 |

FOREIGN PATENT DOCUMENTS

| | | | |
|---|---|---|---|
| 33811 | 3/1885 | Germany . | |
| 1451491 | 9/1969 | Germany . | |
| 1551838 | 6/1970 | Germany . | |
| 56-113919 | 9/1981 | Japan | 110/242 |
| A-60-76744 | 5/1985 | Japan . | |
| A-63-273718 | 11/1988 | Japan . | |
| A-3-29471 | 2/1991 | Japan . | |
| A-7-77317 | 3/1995 | Japan . | |
| WO 9325848 | 12/1993 | WIPO . | |
| WO 9713594 | 4/1997 | WIPO . | |

OTHER PUBLICATIONS

Patent Abstract of Japan 59228734, dated May 1986.
Patent Abstracts of Japan Pub. No. 07062516 A, Tocals Co. Ltd, "Member for Molten Metal Bath", Mar. 1995.

*Primary Examiner*—Carl D. Price
*Assistant Examiner*—Ljiljana V. Ciric
*Attorney, Agent, or Firm*—Oliff & Berridge, PLC

[57] ABSTRACT

A burner apparatus uses fuel derived from waste resin. The burner includes a cylindrical body in combination with an oxygen supplier, which form an oxygen deficient atmosphere. While rotating the cylindrical body, a small portion of waste resin is partially combusted to generate heat energy and changes its form to finely divided particles. The heat energy is used for heating and gasifying a remaining larger portion of the waste resin. The produced gas particles are conveyed toward an outlet nozzle of the cylindrical body and are injected outwardly for complete combustion in air.

5 Claims, 3 Drawing Sheets

BURNER APPARATUS

BACKGROUND OF THE INVENTION

1. Field of Invention

This invention relates to a burner apparatus for treatment of waste resin and, more particularly, to a burner apparatus for treatment of waste resin, which is capable of gasifying waste resin in a burner body to produce a combustible gas and injecting the obtained combustible gas outwardly through a nozzle.

2. Description of Related Art

There have heretofore been provided various techniques for treating waste resin.

For example, there is provided a method comprising the steps of pyrolyzing solid waste resin in a dry distillation furnace to produce a gas, subjecting the generated gas to a catalyst treatment with a catalyst layer, cooling the so-treated gas to separate away a liquid oil from the gas, percolating the separated liquid oil, and combusting the percolated oil to produce heat energy.

Further, Japanese Laid Open Disclosure (kokai) No. hei 7-77317 discloses a method for finely dividing solid waste resin by means of a pulverizer and combusting the ground waste resin in a burner together with powered coal or the like.

Disadvantageously, the above-mentioned two methods, however, require large-scale equipment and high running costs.

Furthermore, in the two methods, apparatuses required for treatment of resin depend on the resins to be treated. If two or more kinds of resins are treated in mixture, the mixture can not be completely treated in a single apparatus.

Alternatively, Japanese Laid-Open Disclosure (kokai) No. sho 60-76744 discloses a method comprising the steps of dry distilling waste resin in a dry distillation furnace to produce a gas, supplying the gas into a heater and combusting the supplied gas in the heater to generate heat energy. The heat energy can be utilized as a supplementary heat energy.

The above-mentioned method, however, involves difficulty in a continuous operation because the dry distillation furnace is operated on a batch basis. Further, once its operation is initiated, it is difficult to intermittently pulse the operation and control the pre-set operation conditions.

Further, Japanese Laid-Open Disclosure (kokai) No. sho 63-273718 discloses an apparatus comprising a cylindrical, outer pot and an inner pot disposed in the outer pot on the central portion thereof, and a method, with the apparatus, comprising the steps of feeding waste resin successively into the inner pot and supplying into the space defined by the outer pot and the inner pot, combustion flame and air for combustion thereby to completely combust the fed waste resin to produce heat energy.

Disadvantageously, when the method is conducted, the interior of the outer pot is heated to extremely high temperature because the fed waste resin is completely combusted. Therefore, the outer pot and the inner pot may not be formed of cast steel, which is not expensive, but must be formed of refractory ceramic tiles, which is expensive. Accordingly, the method causes a considerable increase in cost.

Further, it is difficult to properly determine the quantity of air for combustion of the fed waste resin in the inner pot to completely combust the waste resin. Some resins may be incompletely combusted. Further, some resins may be left as an uncombusted deposit on the outer pot.

As set forth above, it has not been easy to obtain heat energy from waste resin. Thus, almost all of waste resin are disposed by firing or embedding. That is to say, waste resin has not yet be utilized as a heat energy.

SUMMARY OF THE INVENTION

For the purpose of solving the above-mentioned problems, this invention is accomplished.

An object of the invention is to provide a burner apparatus for treatment of waste resin to generate heat energy, requiring no large-scale equipment and having reduced running costs.

A further object of the invention is to provide a burner apparatus for treatment of waste resin to generate heat energy which is constructed of a burner body made of cast steel and the like, which is cheaper than refractory ceramic tile, and can treat more than one kind of waste resins simultaneously, to leave no uncombusted resin deposited on the burner body.

Another object of the invention is to provide a burner apparatus for treatment of waste resin to produce heat energy, which is capable of being continuously operated and being controlled under operation, whereby heat energy is easily obtained from waste resin without converting waste resin to an oil state and grinding waste resin by means of a pulverizer.

Other and further objects of the invention will become obvious upon an understanding of the illustrative embodiments about to be described or will be indicated in the appended claims, and various advantages not referred to herein will occur to one skilled in the art upon use of the invention in practice.

According to the invention, there is provided a burner apparatus, comprising:

a cylindrical body adapted for controllable rotation about an axis of rotation, the cylindrical body having an opening at one end in the axial direction;

a rotating member for rotating the cylindrical body;

a resin feeder for controllably feeding waste resin into the cylindrical body, the resin feeder having an inlet entering through the opening into the cylindrical body and communicating through the opening with the cylindrical body;

an oxygen supplier for controllably and continuously supplying oxygen into the cylindrical body in a gaseous stream form in the axial direction, the oxygen supplier having an intake entering through the opening into the cylindrical body and communicating through the opening with the cylindrical body; the oxygen supplier being controlled to supply into the cylindrical body oxygen of a quantity which is smaller than a theoretical quantity of oxygen for combusting the fed waste resin;

a grinding and agitating member disposed in the burner body for grinding and agitating the fed waste resin to accelerate gasification of the fed waste resin, the grinding and agitating member being adapted to operate upon rotation of the cylindrical body;

an igniter disposed in the cylindrical body for igniting the fed waste resin whereby the fed waste resin is ignited in an oxygen deficient atmosphere to produce a combustible gas and combusted finely-divided particles; and a nozzle through which the produced combustible gas and combustible finely divided particles are injected outwardly and ignited, the nozzle being provided at the other end of the cylindrical body coaxially with the cylindrical body and sealably connected to the cylindrical body.

Preferably, the cylindrical body has an inner surface with a circular configuration and a plurality of fins attached on the inner surface with each fin extending in the axial direction and projecting toward the rotation axis of the cylindrical body.

Preferably, the cylindrical body has an inner surface with a polygonal configuration.

Preferably, the grinding and agitating member comprises a plurality of metal, ceramic or cermet balls.

Preferably, the cylindrical body is made of metal.

BRIEF DESCRIPTION OF THE DRAWINGS

By way of example and to make the description clearer, reference is made to the accompanying drawings in which.

DETAILED DESCRIPTION OF PREFERRED EMBODIMENTS

Figure 2:
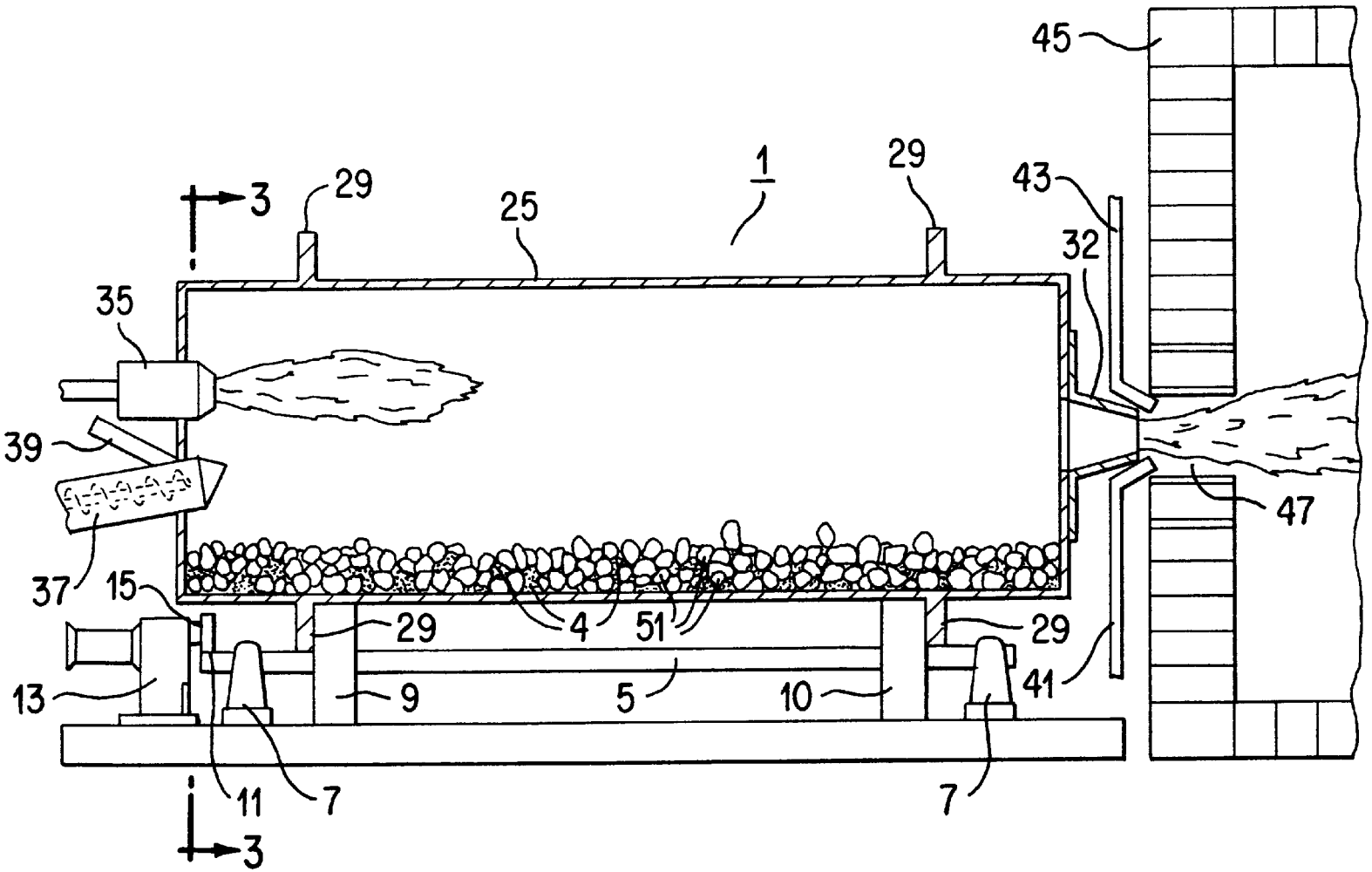
FIG. 2 is a transverse, cross-sectional view of the burner apparatus taken along line 2—2 of FIG. 1.
Figure 3:
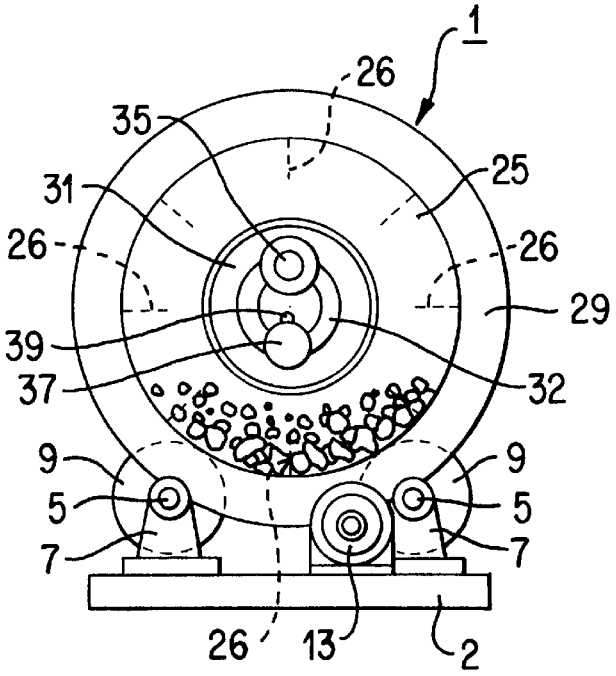
FIG. 3 is a side view of the burner apparatus taken along line 3—3 of FIG. 2.

A first embodiment of a burner apparatus 1 according to the invention will be explained with reference to FIGS. 1 to 3.

Numerical symbol 2 denotes a base. On the base 2 are installed two pairs of bearings 7.

There are provided two pairs of rotary shafts 5. Each rotary shaft 5 is supported rotatably by one pair of the bearings 7.

There are provided two pairs of rollers 9 and 10. Each pair of the rollers 9 and 10 is put on each rotary shaft 5. The rollers 9 and 10 of one set are disposed away from each other. One of the rotary shaft 5 is linked at one end to a gear 11.

On the base 2 is placed a motor 13. The motor 13 is provided with a gear 15. The gear 15 is connected to the driving shaft of the motor 13. The gear 15 is engaged with the gear 11.

The bearings 7, the rotary shafts 5, the rollers 9 and 10, the gear 11, the motor 13 and the gear 15 constitute a rotating member for rotating a burner body 25, which will be described below.

Figure 1:
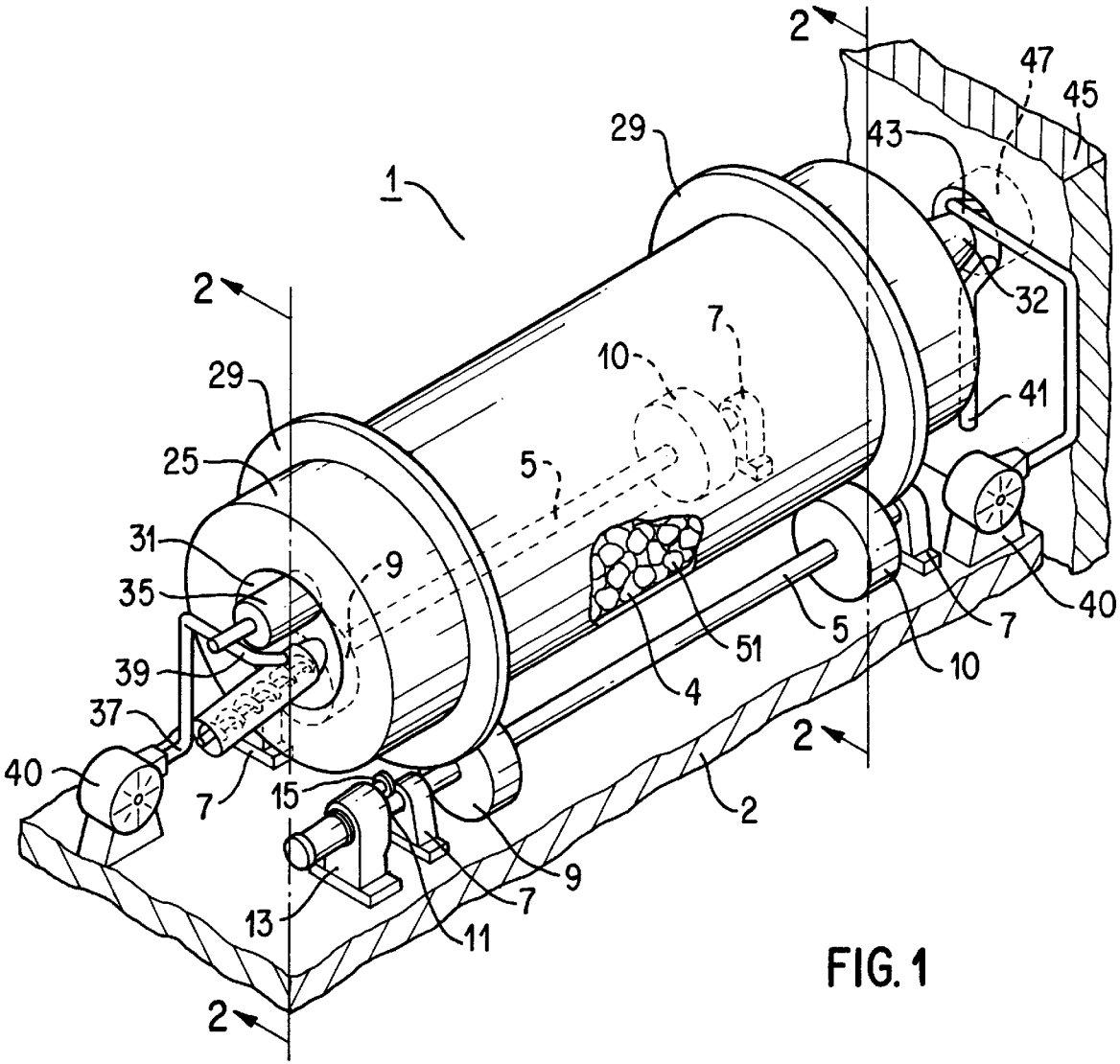
FIG. 1 is a perspective view of a burner apparatus according to the invention.
Figure 5:
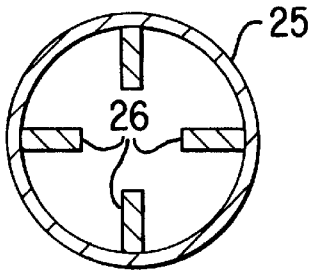
FIG. 5 is a cross-sectional view of another modification of the burner apparatus having the cylindrical body with a plurality of inwardly radially-projecting fins.

As shown in FIG. 1, the burner body 25 is cylindrical. Accordingly, the burner body 25 is hereinbelow referred to as a cylindrical body 25. The cylindrical body 25 is made of cast steel. Further, the cylindrical body 25 is provided with a plurality of fins 26 (as shown in FIG. 5). Each fin 26 extends on the inner surface of the cylindrical body 25 in the axial direction and projects toward the central axis of rotation of the cylindrical body 25. At the one end of the cylindrical body 25 in the axial direction is formed an opening 31. At the other end is provided a nozzle 32. The nozzle 32 is positioned coaxially with the cylindrical body 25.

The cylindrical body 25 takes proper sizes. Accordingly, the burner apparatus 1 requires no large-scale equipment.

The cylindrical body 25 is provided with two flanges 29 along its outer circumference. The two flanges 29 are spaced apart by a given distance from each other.

The cylindrical body 25 is placed on two pairs of the roller 9 and the roller 10. The roller 9 and the roller 10 are positioned between the two flanges 29. Consequently, the cylindrical body 25 is prevented from shifting in the axial direction.

Figure 6:
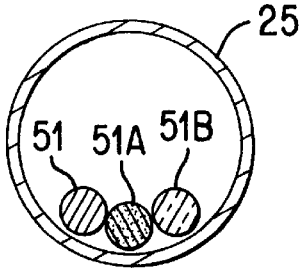
FIG. 6 is a cross-sectional view of another modification of the burner apparatus having a grinding and agitating member comprising a plurality of metal, ceramic and cermet balls.

The cylindrical body 25 holds a plurality of metallic balls 51 in the interior (as shown in FIG. 6). The balls 51 serve as a grinder as well as an agitator. The metallic balls 51 are made of cast steel.

Numerical symbol 35 denotes a burner which serves to ignite waste resin. The orifice of the burner 35 enters through the opening 31 into the cylindrical body 25.

Numerical symbol 37 denotes a screw conveyor which serves to feed waste resin the cylindrical body 25. The tip (or inlet) of the screw conveyor 37 enters through the opening 31 into the cylindrical body 25. The screw conveyor 37 is connected and communicates with an air supply pipe 39. The air supply pipe 39 is connected with a blower 40. The air supply pipe 39 and the blower 40 construct a primary oxygen supplier for combustion of the fed waste resin. They are controlled to supply oxygen into the cylindrical body 25 to form an oxygen deficient atmosphere. That is, they are controlled to supply oxygen of a quantity which is smaller than a theoretical quantity of oxygen for combusting the fed waste resin 4. The air is supplied into the cylindrical body 25 in the axial direction.

Numerical symbol 45 denotes part of a reverberatory furnace. The reverberatory furnace 45 has an opening 47 through its wall. The nozzle 32 is opposed to the opening 47.

In the vicinity of the orifice of the nozzle 32 are disposed a supplementary air supply pipe 43 and an ignition burner 41. The supplementary air supply pipe 43 is connected with a blower (not shown). The supplementary air supply pipe 43 and the blower constitute an oxygen supplier for complete combustion of an combustible gas and combustible finely divided particles, which are described hereinbelow.

The nozzle 32, the reverberatory furnace 45, the supplementary air supply pipe 43 and the ignition burner 41 are spaced apart from each other.

The burner 1 is operated as described below.

The waste resin 4 is fed into the cylindrical body 25 by means of the screw conveyor 37. The waste resin 4 includes, but is not limited to, a mixture of cross-linked polyethylene, high-density polyethylene and PET resin and the like.

Air is supplied from the air supply pipe 39 through the screw conveyor 37 into the cylindrical body 25.

When the motor 13 is driven, the gear 15 (which is provided about the shaft of the motor 13) rotates and, thus, forces the gear 11 to rotate. Upon rotation of the gear 11, one of the rotary shaft 5 (about which the gear 11 is provided), together with the roller 9 and the roller 10 (which is provided about the gear 11) rotates. Upon rotation of the roller 9 and the roller 10, the cylindrical body 25 (which is placed on the roller 9 and the roller 10 ) rotates. Upon rotation of the cylindrical body 25, the other shaft 5 (about which the gear 11 is not provided) rotates together with the roller 9 and the roller 10 (which are provided about the other shaft 5).

The nozzle 32 is positioned coaxially with the cylindrical body 25. Accordingly, when the cylindrical body 25 rotates, the nozzle 32 rotates without any eccentric motion. Accordingly, the nozzle 32 makes an instant distance with the opening 47.

When the cylindrical body 25 rotates, the fed waste resin 4 is ground and agitated by tumbling action of the metallic balls 51 and agitated by the fins 26.

The burner 35 ignites the ground waste resin 4. Because the interior of the cylindrical body makes an oxygen deficient atmosphere, only a portion of the waste resin 4 is combusted to convert to combustible finely divided particles and a remaining, larger portion thereof converts to a combustible gas (which has not yet been combusted) and remains in the cylindrical body 25.

Due to the tumbling action of the metallic balls 51 within the cylindrical body 25, the waste resin 4 is dispersed and distributed through the cylindrical body 25. Accordingly, the exposed surface area of the waste resin 4 is increased and, thus, heat energy is effectively absorbed into the waste resin 4. Further, the tumbling action of the metallic ball 51 agitates the waste resin 4. Consequently, the larger portion of the waste resin 4 rapidly gasifies to make a high-calorie, combustible gas. Because the metallic balls 51 always abrade the inner surface of the cylindrical body 25, the waste resin 4 is momentarily scraped off from the inner surface by the metallic balls 51, even if the waste resin 4 is melted and deposited on the inner surface. Accordingly, no waste resin remains in the cylindrical body 25 as a deposit adhered to the inner surface.

Rotation of the cylindrical body 25 causes consecutive change of the contact area between the inner surface of the cylindrical body 25 and the waste resin 4 whereby the inner surface of the cylindrical body 25 is prevented from being locally overheated to extremely high temperatures due to the contact with the heated waste resin 4.

Within the cylindrical body 25, the waste resin 4 is not completely combusted. Accordingly, no high heat energy due to complete combustion of the waste resin 4 is generated in the cylindrical body 25. The combustible gas and combustible finely divided particles (which has been produced within the cylindrical body 25) completely combust after they are injected outwardly through the nozzle 32. Therefore, the inner surface of the cylindrical body 25 experiences neither considerable high-temperature oxidation nor deformation and exhibits enhanced durability even if it is made of cast steel.

By controlling the rotary speed of the cylindrical body 25, the feed rate of the waste resin 4 into the cylindrical body 25, the heat power of the burner 35 and the supply rate of the air into the cylindrical body 25, the quantity of a combustible gas produced in the cylindrical body 25 can be controlled. As a result, heat energy generated by combustion of the combustible gas (after passing through the nozzle 32) can easily be controlled. That is to say, the heat power of the burner apparatus 1 can easily be controlled.

Further, according to the kind of waste resin used as the waste resin 4 (or the pyrolyzing temperature of waste resin used as the waste resin 4), by controlling the rotary speed of the cylindrical body 25, the feed rate of the waste resin 4 into the cylindrical body 25, the heat power of the burner 35 and the supply rate of the air into the cylindrical body 25, the quantity of a combustible gas can be controlled. Namely, no matter what kind of waste resin is used (or fed into the cylindrical body 25) as a fuel, the heat energy of the burner apparatus 1 can easily be controlled. If a relatively low-calorie waste resin is used as the waste resin 4, the rotary speed of the cylindrical body 25 and the supply rate of the air into the cylindrical body 25 are increased thereby to accelerate gasification of the low-calorie waste resin. If a relatively high-calorie waste resin is used as the waste resin 4, the rotary speed of the cylindrical body 25 and the supply rate of the air into the cylindrical body 25 are decreased thereby to decelerate gasification of the high-calorie waste resin. Accordingly, even if a low-calorie waste resin is fed into the cylindrical body 25 after a high-calorie waste resin, the heat power of the burner apparatus 1 can be kept constant.

The above-explained combustible gas (which has been produced) is injected through the nozzle 32. Further, the combustible finely divided particles are also injected through the nozzle 32. The combustible gas and the combustible finely divided particles (which have been injected outwardly through the nozzle 32) are completely combusted under conditions where the heat power of the ignition burner 41 is applied and an oxygen gas is forcedly supplied from the supplementary air supply pipe 43 toward the combustible gas and the combustible finely divided particles.

Heat energy generated by complete combustion of the combustible gas and the combustible finely divided particles can be used as a heat source in the reverberatory furnace 45, a dissolving furnaces (not shown), a drying kiln (not shown), and the like.

Explosion of the combustible gas is prevented even if the waste resin 4 is misfired in the cylindrical body 25 because the combustible gas is urged to flow toward the nozzle 32 and after passing through the nozzle 32, the combustible gas is combusted by the ignition burner 41. Conversion reaction of the waste resin 4 (which is a starting material) finally to a combustion gas in the cylindrical body 25 can continuously occur by continuously feeding the waste resin 4. Namely, the burner apparatus 1 can continuously be operated.

Having described our invention as related to the embodiment shown in the accompanying drawings, the scope of the invention should not be limited by the embodiment and various changes and modifications may be made in the invention without departing from the spirit and scope.

Figure 4:
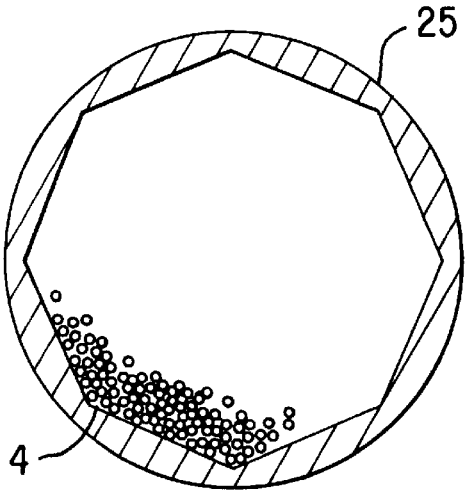
FIG. 4 is a cross-sectional view of a modification of the burner apparatus having a cylindrical body with an inner surface having a polygonal configuration.

Although the cylindrical body 25 of the embodiment is annular in cross-section, the cylindrical body according to the invention is not limited to such a configuration. The cylindrical body according to the invention may take an inner surface of any polygonal configuration such as an octagonal configuration, as shown in FIG. 4. If the cylindrical body according to the invention has an inner surface of a polygonal configuration, the waste resin is lifted on the inner surface upwardly to a position and drops downwardly by gravity action when the cylindrical body rotates. Accordingly, agitation of the waste resin is accelerated. The cylindrical body according to the invention may take an outer surface of any polygonal configuration provided that it is rotatable.

The cylindrical body according to the invention may be made of metals other than cast steel.

The cylindrical body 25 of the embodiment is rotated upon rotation of the rollers 9 and 10. That is to say, the rollers 9 and 10 serve as a rotating member for rotating the cylindrical body 25. However, the rotating member for rotating the cylindrical body according to the invention should not be limited to such rollers. The rotating member according to the invention may be constructed of a gear, a belt, a chain and the like.

The metallic ball 51 may be replaced by cubic or rectangular pieces or fragments. They may be made of metal (including cast steel), ceramic, cermet and the like. A ceramic ball 51A and a cermet ball 51B are shown in FIG. 6.

Alternatively, the grinding and agitating member according to the invention may be a chain, one end of which is attached and fixed to the inner surface of the cylindrical body 25. When the cylindrical body 25 is rotated, the chain moves and the other end of the chain impinges on the waste resin whereby the waste resin is ground and agitated.

Although the embodiment has the ignition burner 41, the ignition burner 41 is not necessarily required provided that the combustible gas and combustible finely divided particles are heated to the ignition point, for example, in the cylindrical body 25. The combustible gas and combustible finely divided particles may be injected directly into a metal-melting furnace (which has been heated to the ignition point).

The waste resin may be fed into the cylindrical body 25 by means of any other devices than the screw conveyor 28 or human power.

Although the cylindrical body 25 is made only of cast steel, a refractory tile may be applied to the inner surface of the cylindrical body 25.

The nozzle may be made of other materials (such as stainless steel or ceramic) than cast steel. If the nozzle is made of stainless steel or ceramic, the nozzle is heated to a temperature higher than the cylindrical body. Accordingly, there is almost no chance to allow the waste resin to keep its shape and to escape outwardly through the nozzle.

The waste resin may be a mixture of several resins.

The burner according to the invention takes a simple configuration. Accordingly, the burner apparatus can easily be manufactured even if it is large-sized (or has a longitudinal diameter of several tens of centimeters to several meters or more).

What is claimed is:

1. A burner assembly, comprising:

a burner apparatus including:

a cylindrical body adapted for controllable rotation about an axis of rotation, the cylindrical body having an opening at one end extending along the axis;

a rotating member operatively connected to the cylindrical body for rotating the cylindrical body about the axis;

a resin feeder for controllably feeding waste resin into the cylindrical body, the resin feeder having an inlet entering through the opening into the cylindrical body and communicating through the opening with the cylindrical body;

an oxygen supplier for controllably and continuously supplying oxygen into the cylindrical body in a gaseous stream form in the axial direction, the oxygen supplier having an intake entering through the opening into the cylindrical body and communicating through the opening with the cylindrical body, the oxygen supplier being controlled to supply a substoichiometric quantity of oxygen into the cylindrical body;

a grinding and agitating member disposed within the cylinder body for grinding and agitating the waste resin to accelerate gasification of the waste resin, the grinding and agitating member being adapted to operate upon rotation of the cylindrical body;

an igniter disposed within the cylindrical body for igniting the waste resin whereby the waste resin is ignited in an oxygen deficient atmosphere to produce a combustible gas and combustible finely-divided particles; and a nozzle through which the produced combustible gas and combustible finely-divided particles are injected outwardly and ignited, the nozzle being located at an opposite end of the cylindrical body, coaxially with and sealably connected to, the cylindrical body; and a reverbatory furnace operatively connected with the burner apparatus and having a wall defining a furnace opening, wherein the nozzle of the burner apparatus cooperates with the furnace opening so that the produced combustible gas and combustible finely-divided particles are injected into the reverbatory furnace.

2. The burner assembly according to claim 1, wherein the cylindrical body has an inner surface with a circular cross-section in a radial direction and a plurality of fins attached to the inner surface, each fin extending in a direction parallel to the axis of rotation of the cylindrical body.

3. The burner assembly according to claim 1, wherein the cylindrical body has an inner surface with a polygonal cross-section in a radial direction.

4. The burner assembly according to claim 1, wherein the grinding and agitating member includes at least one ball fabricated from one of metal, ceramic and cermet.

5. The burner assembly according to claim 1, wherein the cylindrical body is made of metal.

* * * * *